US005086984A

United States Patent [19]

Turek et al.

[11] Patent Number: 5,086,984

[45] Date of Patent: Feb. 11, 1992

[54] METHOD OF PREDICTING YARN PACKAGE DIAMETER

[75] Inventors: Douglas E. Turek, Clayton North, Australia; Mark A. Sibley, Kingston, Canada

[73] Assignee: Du Pont Canada Inc., Mississauga, Canada

[21] Appl. No.: 570,307

[22] Filed: Aug. 20, 1990

[30] Foreign Application Priority Data

Aug. 30, 1989 [CA] Canada ..... 609839

[51] Int. Cl.[5] ..... B65H 54/00; B65H 61/00

[52] U.S. Cl. ..... 242/18 R; 242/36; 242/39

[58] Field of Search ..... 242/18 R, 18 DD, 36, 242/39, 49, 28, 30, 57

[56] References Cited

U.S. PATENT DOCUMENTS 4,373,266 2/1983 Stutz ..... 242/36 X
4,447,955 5/1984 Stutz et al. ..... 242/39 X
4,494,702 1/1985 Miyake et al. ..... 242/36 X
4,715,548 12/1987 Miyake et al. ..... 242/36 X
4,805,844 2/1989 Hermanns et al. ..... 242/36 X
4,828,191 5/1989 Ruge et al. ..... 242/39 X

*Primary Examiner*—Stanley N. Gilreath

[57] ABSTRACT

A method of predicting final yarn package diameter (D) during winding of yarn onto the package. The yarn is to be wound onto the package for a known period of time (TD) to obtain the final yarn package diameter. The method comprises the steps of: measuring the time (TS) for the package to grow to a known diameter (DS); predicting yarn package diameter using the correlation:

$$D = \text{square root}\ [k1 + k2(TD/TS)]$$

wherein k1 and k2 are empirically determined constants.

2 Claims, 2 Drawing Sheets

METHOD OF PREDICTING YARN PACKAGE DIAMETER

BACKGROUND OF THE INVENTION

This invention relates to the prediction of yarn package diameter.

Yarn wound on a rotating bobbin is referred to in the trade as a "package". The diameter of this package is generally not controlled and is a function of such factors as winding time, winding tension, winding speed and yarn bulk. It is important to be able to measure yarn package diameter, since this measurement will provide information about the properties of the yarn, such as yarn bulk level, so that these properties may be controlled. Moreover, if the packages are too large it may be difficult to pack the yarn packages into cartons or mount the yarn packages onto machinery.

New winding apparatuses include built-in detectors to measure yarn package diameter by various means. Most of these provide a continuous signal representative of the package diameter based on the position of some indicative component. However, modifications to existing winding apparatus not employing package diameter detectors of current design, is usually difficult and expensive.

It is desired to predict yarn package diameter of yarn wound on existing winding apparatus employing minimum modification.

SUMMARY OF THE INVENTION

Accordingly, the invention provides a method of predicting final yarn package diameter (D) during winding of yarn onto said package, said yarn to be wound onto said package for a predetermined period of time (TD) to obtain said final yarn package diameter, said method comprising the steps of:

measuring the time (TS) for the package to grow to a predetermined diameter (DS); and predicting yarn package diameter using the correlation:

$$D = \text{squareroot}[k1 = k2(TD/TS)] \quad (1)$$

wherein k1 and k2 are empirically determined constants.

DESCRIPTION OF THE PREFERRED EMBODIMENTS

The present invention may be used with substantially any type of yarn, but is most preferably used with bulky yarn, such as nylon or polyester carpet yarn.

The correlation of equation (1) was derived as follows: assuming a constant rate of growth of the package during package winding time, $$\frac{AS - AT}{TS} = \frac{AD - AT}{TD}$$

where:

TD is the total time required to achieve final package diameter;

AD is the area of the package at time TD;

AT is the initial package or bobbin area before yarn is wound onto it;

AS is a predetermined area of the package which is less that expected AD; and

TS is the time required to achieve package area AS, therefore, $$AD = \frac{TD}{TS} \times (AS - AT) + AT$$

substituting in the equation $$\text{Area} = \frac{(\text{pi})\ \text{diameter}^2}{4}$$

and simplifying, the equation becomes:

$$D^2 = \frac{TD}{TS}(DS^2 - DT^2) + DT^2$$

where D is the final predetermined diameter and DS and DT are the predetermined diameter and initial diameter respectively, which are constants, so that equation may be reported as:

$$D = \text{square root}[k1(TD/TS) + K2]$$

The constants k1 and k2 may be determined empirically by measuring D, TD and TS for several packages and using regressional analysis.

The invention will be further described, by way of example only, with reference to the following drawings in which.

Figure 1:
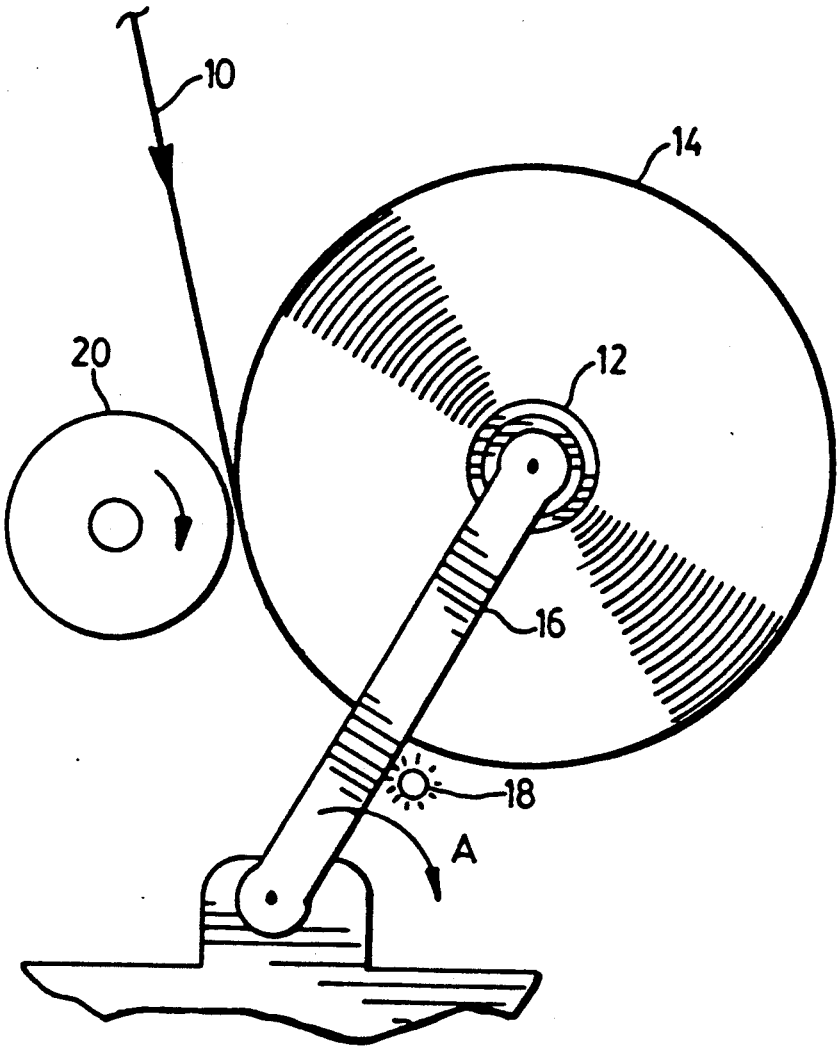
FIG. 1, is a diagrammatic representation of a winding apparatus.

As may be seen in FIG. 1, yarn 10 is wound onto a bobbin 12 by a friction driver roller 20 to create a package 14. An arm 16 is rotated in the direction or Arrow A as the package diameter increases. An infra-red sensor 18 detects the movement of this arm and gives a signal when the arm has rotated about a predetermined angle, which represents the growth of the package to predetermined diameter DS.

The mounting of this inexpensive, non-intrusive non-contacting sensor 18 represents the only physical modification to the winding equipment required.

After the constants have been calculated, package diameter D may be predicted using Equation (1). TD will generally be known, since most winding apparatuses only wind the yarn onto the package for a fixed period of time, or in other cases can be simply measured by monitoring winder control signals. TS is determined using the apparatus of FIG. 1, and represents the period between the time the yarn 10 began to be wound onto the bobbin 12 and the time the sensor 18 gives a signal.

For known package winding times, TD, this algorithm can predict the expected diameter of package before it is produced. This information can in turn be employed to immediately modify the winding process by for example, controlling winding tension and winding time to produce an optimum diameter package by the time winding is complete.

The measurement of the time to activate the sensor switch, and if applicable the total time for package growth, as well as the calculation of the package diameter may be performed by any suitable instrumentation system known in the art. A report of the package diameters manufactured may be produced using such a system.

The following example further illustrates the invention.

EXAMPLE

The constants k1 and k2 of equation (1) were determined experimentally by varying TD and measuring TS and D. The results of this experimentation are reported in Table 1 below.

$$D = \text{square root}[k1 + k2(TD/TS)]$$

Using regressional analysis, the correlation was determined to be:

$$D(\text{cm}) = \text{square root}[100.41(\text{cm}^2) + 482.68(\text{cm}^2) \times (TD/TS)] \quad (2)$$

Figure 2:
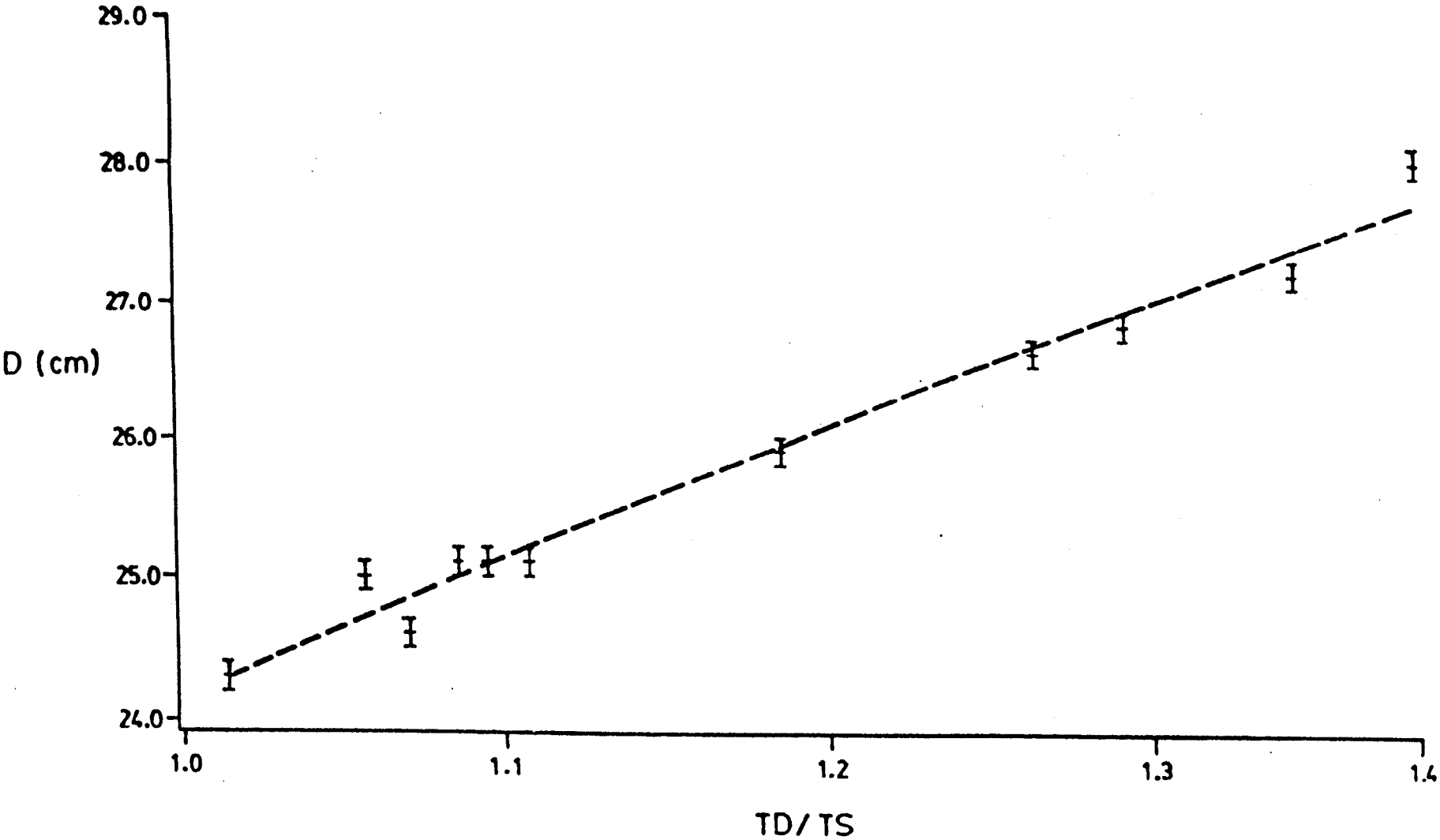
FIG. 2 is a graph of package diameter versus the ratio TD/TS.

Package diameter was then predicted using this equation for given values of TD/TS. The actual package diameter for a measured value of TD/TS was measured and compared against the prediction. The results are reported in FIG. 2. The predicted package diameter is indicted by a dotted line and the actual measured package diameter is indicated by the individual points. The small vertical bars represent an estimate of the measurement error associated with measurements of the package size. This Figure indicates that there is a close correlation between diameter predicted by Equation (2) and actual diameter.

TABLE 1

| D(cm) | TD(seconds) | TS(seconds) |
|---|---|---|
| 24.3 | 1288 | 1270 |
| 24.6 | 1392 | 1301 |
| 25.1 | 1436 | 1296 |
| 25.9 | 1538 | 1296 |
| 26.6 | 1603 | 1268 |
| 26.8 | 1682 | 1301 |
| 27.2 | 1733 | 1289 |
| 28.0 | 1795 | 1299 |

We claim:

1. A method of predicting final yarn package diameter (D) during winding of yarn onto said package, said yarn to be wound onto said package for a known period of time (TD) to obtain said final yarn package diameter, said method comprising the steps of:

measuring the time (TS) for the package to grow to a predetermined diameter (DS);

predicting yarn package size using the correlation:

$$D = \text{square root}[k1 + k2(TD/TS)]$$

wherein k1 and k2 are empirically determined constants derived from varying TD and measuring TS and the final yarn package diameter.

2. The method of claim 1 wherein the time (TS) is measured by detecting the time taken for a lever arm in contact with the center of the package to rotate about a predetermined angle corresponding to said predetermined diameter.

* * * * *